US010845055B2

(12) United States Patent
Roh et al.

(10) Patent No.: US 10,845,055 B2
(45) Date of Patent: Nov. 24, 2020

(54) FUEL NOZZLE ASSEMBLY, AND COMBUSTOR AND GAS TURBINE INCLUDING THE SAME

(71) Applicant: DOOSAN HEAVY INDUSTRIES & CONSTRUCTION CO., LTD., Changwon-si (KR)

(72) Inventors: Ujin Roh, Changwon-si (KR); Jongho Uhm, Yongin-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 246 days.

(21) Appl. No.: 16/015,187

(22) Filed: Jun. 22, 2018

(65) Prior Publication Data

US 2019/0011131 A1 Jan. 10, 2019

(30) Foreign Application Priority Data

Jul. 4, 2017 (KR) ..... 10-2017-0085079

(51) Int. Cl.
*F23R 3/10* (2006.01)
*F23R 3/28* (2006.01)
(Continued)

(52) U.S. Cl.
CPC ..... *F23R 3/286* (2013.01); *F23D 14/62* (2013.01); *F23D 14/82* (2013.01); *F23D 23/00* (2013.01);
(Continued)

(58) Field of Classification Search
CPC ..... F23R 3/46
See application file for complete search history.

(56) References Cited

U.S. PATENT DOCUMENTS 3,834,159 A * 9/1974 Vdoviak ..... F23R 3/14 60/746
6,430,930 B1 * 8/2002 Andersson ..... F23D 23/00 431/114
(Continued)

FOREIGN PATENT DOCUMENTS

CN 104896510 A 9/2015
EP 2520865 A2 11/2012
(Continued)

OTHER PUBLICATIONS

An European Search Report dated Oct. 26, 2018 in connection with European Patent Application No. 18181576.2 which corresponds to the above-referenced U.S. application.
(Continued)

*Primary Examiner* — Gerald L Sung
*Assistant Examiner* — Marc J Amar
(74) *Attorney, Agent, or Firm* — Invenstone Patent, LLC

(57) ABSTRACT

A fuel nozzle assembly includes an inner fuel nozzle; a plurality of outer fuel nozzles disposed radially around the inner fuel nozzle, each outer fuel nozzle including a central body for fuel injection, a shroud spaced apart from and surrounding the central body, the shrouds forming an outer periphery of the fuel nozzle assembly, and an inlet formed at one end of the shroud; and a peripheral rim formed at the inlets and disposed to cover at least a portion of the outer periphery. The fuel nozzle assembly is connected to an end plate of a combustion chamber. The one end of a corresponding shroud is disposed at a set distance from an end plate of a combustion chamber, the set distance depending on at least one of relative positions of the inner fuel nozzle and the plurality of outer fuel nozzles and an inlet radius of the corresponding shroud.

15 Claims, 10 Drawing Sheets

(51) Int. Cl.

| | |
|---|---|
| ***F23D 23/00*** | (2006.01) |
| ***F23R 3/46*** | (2006.01) |
| ***F23D 14/82*** | (2006.01) |
| ***F23R 3/14*** | (2006.01) |
| ***F23D 14/62*** | (2006.01) |
| ***F23R 3/04*** | (2006.01) |
| ***F23R 3/00*** | (2006.01) |

(52) U.S. Cl.
CPC ..... *F23R 3/002* (2013.01); *F23R 3/045* (2013.01); *F23R 3/10* (2013.01); *F23R 3/14* (2013.01); *F23R 3/46* (2013.01); *F23D 2203/007* (2013.01); *F23D 2209/10* (2013.01); *F23D 2900/14701* (2013.01)

(56) References Cited

U.S. PATENT DOCUMENTS

| | | | | |
|---|---|---|---|---|
| 6,672,073 | B2 | 1/2004 | Wiebe | |
| 8,371,123 | B2 | 2/2013 | Stewart et al. | |
| 10,060,630 | B2 * | 8/2018 | Stuttaford | F23R 3/34 |
| 2004/0050058 | A1 * | 3/2004 | Ohri | F23R 3/14 60/748 |
| 2009/0061369 | A1 * | 3/2009 | Wang | F23M 20/005 431/114 |
| 2011/0094232 | A1 * | 4/2011 | Stewart | F23R 3/10 60/734 |
| 2012/0085100 | A1 | 4/2012 | Hughes et al. | |
| 2012/0174589 | A1 | 7/2012 | Bailey et al. | |
| 2012/0180487 | A1 | 7/2012 | Uhm et al. | |
| 2012/0180494 | A1 | 7/2012 | Bailey et al. | |
| 2012/0181354 | A1 | 7/2012 | Bailey et al. | |
| 2012/0279224 | A1 | 11/2012 | Bailey et al. | |
| 2013/0061594 | A1 * | 3/2013 | Stewart | F23R 3/10 60/740 |
| 2014/0007578 | A1 * | 1/2014 | Genin | F23C 6/047 60/737 |

FOREIGN PATENT DOCUMENTS

| | | | | |
|---|---|---|---|---|
| EP | 2532964 | A2 | 12/2012 | |
| EP | 2568221 | A2 | 3/2013 | |
| EP | 2657608 | A2 | 10/2013 | |
| JP | 2003090535 | A | 3/2003 | |
| JP | 2014-215036 | A | 11/2014 | |
| KR | 1982-0001469 | B1 | 8/1982 | |
| KR | 10-1999-0054621 | A | 7/1999 | |
| WO | WO-2018205889 | A1 * | 11/2018 | F23R 3/46 |

OTHER PUBLICATIONS

A Korean Office Action dated Jan. 30, 2019 in connection with Korean Patent Application No. 10-2017-0085079 which corresponds to the above-referenced U.S. application.

A Korean Office Action dated Jul. 9, 2018 in connection with Korean Patent Application No. 10-2017-0085079 which corresponds to the above-referenced U.S. application.

* cited by examiner

FUEL NOZZLE ASSEMBLY, AND COMBUSTOR AND GAS TURBINE INCLUDING THE SAME

CROSS-REFERENCE TO RELATED APPLICATIONS

This application claims priority to and the benefit of Korean Patent Application No. 10-2017-0085079 filed in the Korean Intellectual Property Office on Jul. 4, 2017, the entire contents of which are incorporated herein by reference.

BACKGROUND OF THE INVENTION

Field of the Invention

The present invention relates to a fuel nozzle assembly having a plurality of fuel nozzles, a combustor including the fuel nozzle assembly, and a gas turbine including the combustor, and more particularly to a fuel nozzle assembly in which uniform airflow of compressed air introduced into the fuel nozzle assembly is facilitated by a peripheral rim.

Description of the Related Art

A gas turbine is a power engine that generates a hot gas through combustion of compressed air and fuel and rotates a turbine with the hot gas. The gas turbine is used for combined-cycle power generation and cogeneration.

The gas turbine is roughly divided into a compressor, a combustor, and a turbine. The compressor sucks in and compresses the outside air and delivers the compressed air to the combustor. The compressed air is in a state of high pressure and high temperature. The combustor mixes the compressed air entered from the compressor with fuel injected through swirl vanes arranged in a fuel nozzle assembly composed of fuel nozzles and burns the mixture to produce a combustion gas. The combustion gas is discharged to the turbine, by which the turbine rotates to generate power.

Specifically, the air compressed by the compressor flows into each combustor of a plurality of combustors, each combustor including a fuel nozzle assembly having a plurality of fuel nozzles. In the combustor, fuel is injected through swirl vanes arranged in each fuel nozzle and is then mixed with the compressed air. The mixture of fuel and air is burned in a combustion chamber located at a downstream of each fuel nozzle assembly, and the combustion gas is discharged through a hot gas path within the turbine.

Meanwhile, it is important to maintain uniform airflow as the compressed air is introduced into the fuel nozzle assembly and as the air is supplied to the fuel nozzles. This uniform flow of air is needed to uniformly mix the air with the fuel. Further, in order to make a stable combustion, it is needed to combust the uniform mixture of the air and fuel.

However, when the compressed air is introduced into the fuel nozzle assembly, the directionality of the airflow is inherently changed. A change in airflow direction tends to disrupt or interrupt the uniform flow of air and may create a small region where the airflow is slowed or the pressure is low, i.e., an air pocket. A region where the flow rate of air through a fuel nozzle assembly is low may cause a flame anchoring in the fuel nozzles, thereby damaging fuel nozzle components. In addition, the low flow of air supplied to the fuel nozzle assembly may invite partial changes in the mixture of air and fuel, thus increasing a combustion temperature or creating excessive nitrogen oxides (NOx).

SUMMARY OF THE INVENTION

Accordingly, it is an object of the present invention to provide a fuel nozzle assembly capable of a uniform inflow of air to uniformly supply air into respective fuel nozzles of the fuel nozzle assembly.

It is a further object of the present invention to provide a combustor including the fuel nozzle assembly and to provide a gas turbine including the combustor.

According to one aspect of the present invention, a fuel nozzle assembly may include an inner fuel nozzle; a plurality of outer fuel nozzles disposed radially around the inner fuel nozzle, each outer fuel nozzle including a central body for fuel injection, a shroud spaced apart from and surrounding the central body, the plurality of shrouds forming an outer periphery of the fuel nozzle assembly, and an inlet formed at one end of the shroud; and a peripheral rim formed at the inlets and disposed to cover at least a portion of the outer periphery.

The peripheral rim may include a fuel nozzle rim formed to cover at least a portion of the inlet of the shroud of at least one of the plurality of outer fuel nozzles.

One of the plurality of outer fuel nozzles may include a fuel nozzle rim having an angle ranging from 90 degrees to 240 degrees around a center of the one of the outer fuel nozzles.

The peripheral rim may be curved outwardly to have a uniform curvature radius. The peripheral rim may have at least two different curvature radii. At least two of the plurality of outer fuel nozzles may have different inlet radii of a corresponding shroud. The peripheral rim may include a fuel nozzle rim having a curvature radius that depends on the inlet radius. The curvature radius of the fuel nozzle rim formed on the shroud having a small inlet radius may be greater than the curvature radius of the fuel nozzle rim formed on the shroud having a large inlet radius.

The inner fuel nozzle may include a central body for fuel injection; a shroud spaced a part from and surrounding the central body of the inner fuel nozzle; and a fuel nozzle rim for m e d at an inlet of the shroud of the inner fuel nozzle. The peripheral rim may follow an outwardly extending curve having a first curvature radius, and the fuel nozzle rim formed on the shroud of the inner fuel nozzle may follow an outwardly extending curve having a second curvature radius. The first curvature radius may be at least 1.05 times greater than the second curvature radius.

The plurality of outer fuel nozzles may include a first outer fuel nozzle group having a first inlet radius of the shroud and a second outer fuel nozzle group having a second inlet radius of the shroud, and the first and second outer fuel nozzle groups may respectively include the first and second typed fuel nozzles alternately arranged around the inner fuel nozzle. The first inlet radius may be greater than the second inlet radius.

According to another aspect of the present invention, a combustor may include a combustion chamber; and the above fuel nozzle assembly mounted in the combustion chamber and connected to an end plate. The one end of a corresponding shroud may be disposed at a set distance from the end plate, the set distance depending on at least one of relative positions of the inner fuel nozzle and the plurality of outer fuel nozzles and an inlet radius of the corresponding shroud.

The shroud of the inner fuel nozzle may be located closer to the end plate than the shrouds of the outer fuel nozzles.

The shrouds of at least two outer fuel nozzles may have different inlet radii, wherein the smaller the inlet radius of the shroud, the shorter the distance between the end plate and the shroud.

The outer fuel nozzles may be classified into a first outer fuel nozzle group having a first inlet radius of the shroud and a second outer fuel nozzle group having a second inlet radius of the shroud, the first inlet radius being greater than the second inlet radius. Assuming a distance L1 between the end plate and the inlet of the shroud of the inner fuel nozzle, a distance L2 between the end plate and the inlet of the shroud of the first outer fuel nozzle group, and a distance L3 between the end plate and the inlet of the shroud of the second outer fuel nozzle group, a relation of the distances may be expressed as $L1<L2<L3$. The relation of the distances may also be expressed as $L1\leq(0.8\times L3)$, or as $L2\leq(0.9\times L3)$.

According to another aspect of the present invention, a gas turbine may include a compressor for compressing air; a combustor for mixing and burning the compressed air and fuel, the combustor including a combustion chamber and the above fuel nozzle assembly mounted in the combustion chamber, the combustion chamber including a combustion liner, a casing disposed to be spaced apart from the combustion liner and to surround the combustion liner, and an end plate combined with the casing and connected to the fuel nozzle assembly; and a turbine for generating power through rotation by a combustion gas received from the combustor, It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
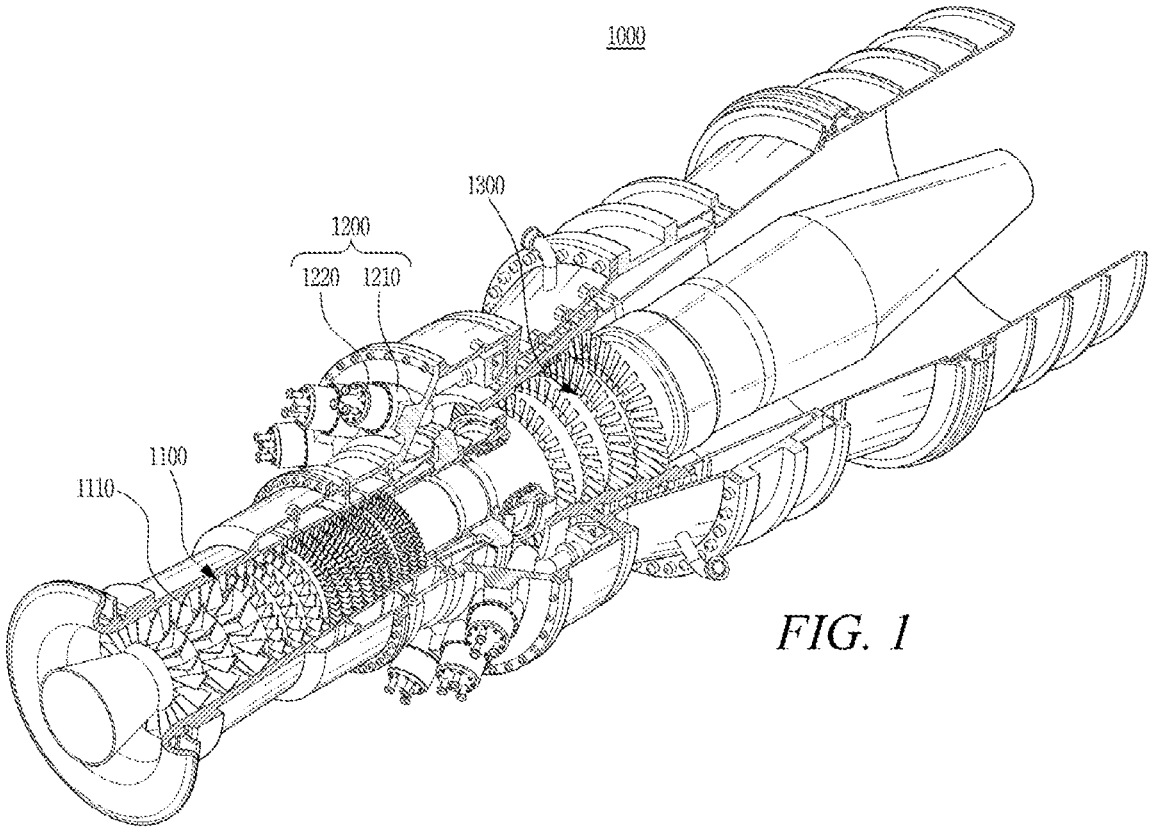
FIG. 1 is a partially cutaway perspective view of a gas turbine including a combustor according to an embodiment of the present invention.

Hereinafter, various embodiments of the present invention will be described in detail with reference to the accompanying drawings. It should be understood that the present invention is not intended to be limited to embodiments disclosed herein and includes various modifications, equivalents, and/or alternatives of the disclosed embodiments.

Terminology used herein is merely for the purpose of describing particular embodiments and is not intended to limit the invention. Singular forms utilizing "a," "an," and "the" are intended to include plural forms unless the context clearly dictates otherwise. In addition, terms such as "comprise," "include," and "have" are intended to specify the presence of stated elements, components, operations, functions, features, steps, or the like, without excluding the presence or possibility of additional other elements, components, operations, functions, features, steps, or the like.

The following description of embodiments may omit descriptions of techniques that a re well known in the art or not directly related to the present disclosure. This is to clearly convey the subject matter of the present disclosure by omitting unnecessary explanation. For the same reason, some elements in the drawings may be exaggerated, omitted, or schematically illustrated. Also, the size of each element does not entirely reflect the actual size. In the drawings, the same or corresponding elements are denoted by the same reference numerals.

Referring to FIG. 1, a gas turbine 1000 according to an embodiment of the present invention includes a compressor 1100, a combustor 1200, and a turbine 1300. In an embodiment, the compressor 1100 may be directly or indirectly connected to the turbine 1300, receive part of the power generated by the turbine 1300, and utilize the received power for rotation of the blades 1110. The compressor 1100 rotates a plurality of radially installed blades 1110, each blade 1110 having a size and installation angle that may vary depending on its installation position, while sucked-in air is compressed by the rotation of the blades 1110 and moves toward the combustor 1200. Thus, the air compressed in the compressor 1100 moves to the combustor 1200, which includes a fuel nozzle assembly 1220 and a combustion chamber 1210.

The combustor 1200 of the present invention is one of a plurality of such combustors arranged around the gas turbine 1000 as part of its combustor section, which is situated, in general, between the compressor 1100 and the turbine 1300.

Figure 2:
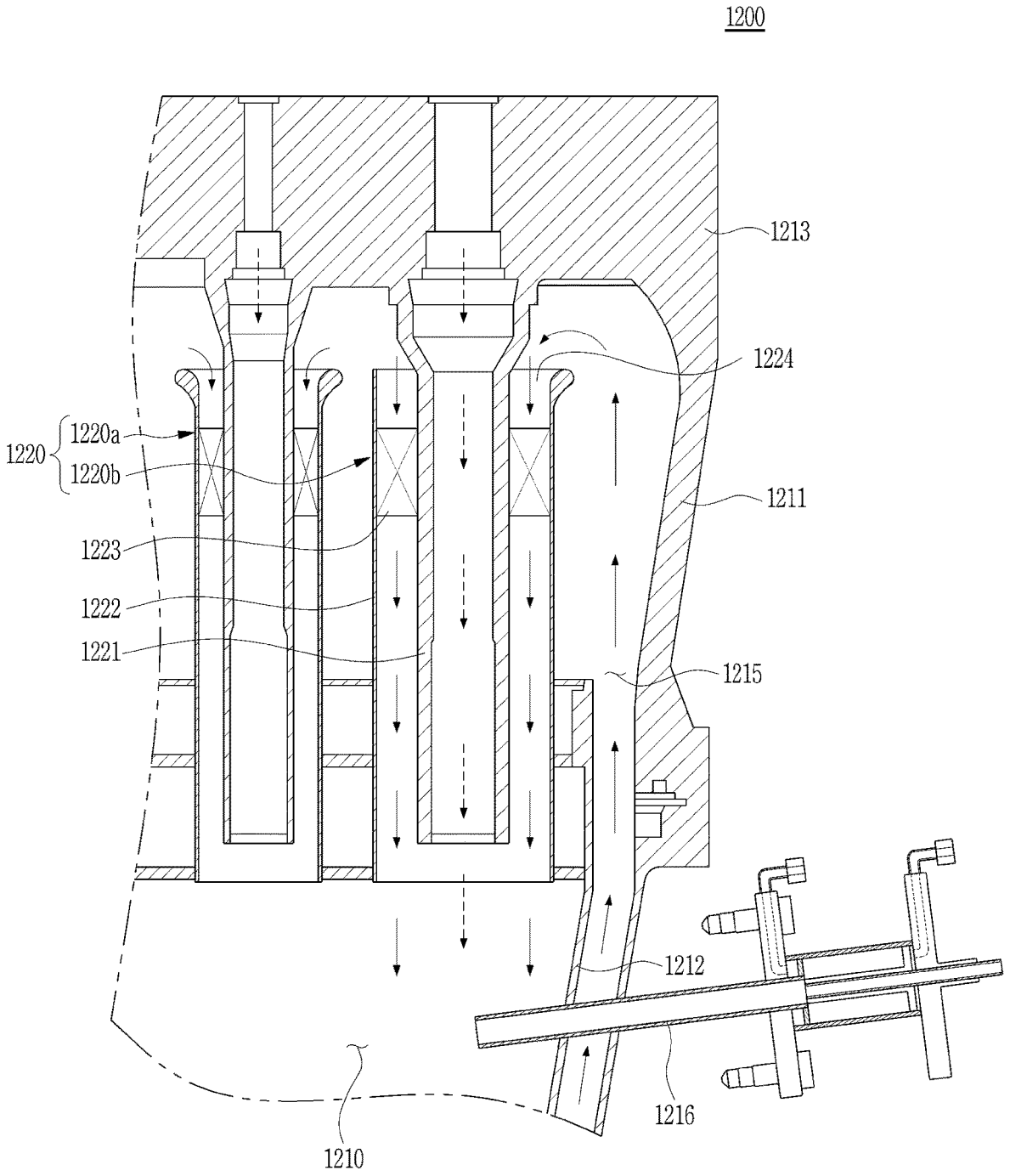
FIG. 2 is a schematic cross-sectional view of a portion of the combustor shown in FIG. 1.

Referring to FIG. 2, the combustion chamber 1210 of the combustor 1200 includes a combustion liner 1212, a casing 1211, and an end plate 1213. The combustion chamber 1210 is a space surrounded by the combustion liner 1212 and a transition piece (not shown). The casing 1211 surrounds the combustion liner 1212 and extends in one direction. Thus, the combustion liner 1212 is disposed inside the casing 1211 and extends in the longitudinal direction of the casing 1211 while being spaced apart from the casing 1211 to form an annular flow space 1215 between the casing 1211 and the combustion liner 1212. The end plate 1213 is joined with the casing 1211 at the end of the casing 1211 and seals the casing 1211. The end plate 1213 may be joined with a manifold (not shown) for supplying fuel to the fuel nozzle assembly 1220, associated valves, and the like.

The fuel nozzle assembly 1220 of the combustor 1200 is connected to one end of the combustion liner 1212 and is thus mounted essentially inside the combustion chamber 1210. That is, one fuel nozzle assembly 1220 is provided for one combustion chamber 1210. The fuel nozzle assembly 1220 includes a plurality of fuel nozzles 1220*a* and 1220*b*, the number of which may vary depending on the capacity of the gas turbine 1000. One end of each fuel nozzle 1220*a* and 1220*b* is supported by the end plate 1213.

Compressed air and fuel are mixed in each fuel nozzle 1220*a* and 1220*b*. Each fuel nozzle 1220*a* and 1220*b* includes a central body 1221, a shroud 1222, and a swirl vane 1223. Fuel for combustion is injected through the central body 1221. One end of the central body 1221 is supported by the end plate 1213. The shroud 1222 is spaced apart from the central body 1221 and surrounds the central body 1221. The shroud 1222 may have a pipe-like shape, e.g., a cylindrical shape. The swirl vane 1223 may be installed in and around the central body 1221 at a position spaced apart from an inlet 1224 of the shroud 1222.

The air compressed in the compressor 1100 flows into the flow space 1215 between the casing 1211 and the combustion liner 1212. The compressed air flowing along the flow space 1215 reaches the end plate 1213 located at the end of the casing 1211. The compressed air is diverted at the end plate 1213, that is, its airflow directionality is changed, and the air then flows into the inlet 1224 of the shroud 1222 of the fuel nozzle assembly 1220. The compressed air flowing into the shroud 1222 moves to the combustion chamber 1210 while being mixed with the fuel injected through the central body 1221. In the combustion chamber 1210, ignition is performed by a spark plug 1216, and combustion occurs. A combustion gas is then discharged to the turbine 1300 to rotate the turbine 1300.

Figure 3A:
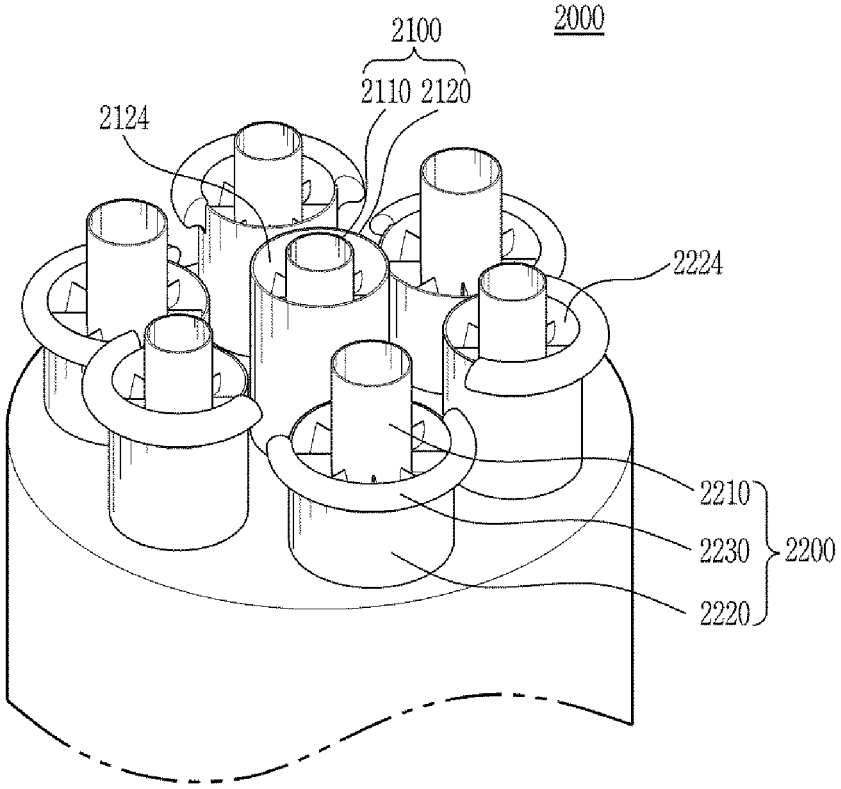
FIGS. 3A and 3B are perspective views of a fuel nozzle assembly according to embodiments of the present invention, respectively showing alternative formations of a fuel nozzle rim.
Figure 3B:
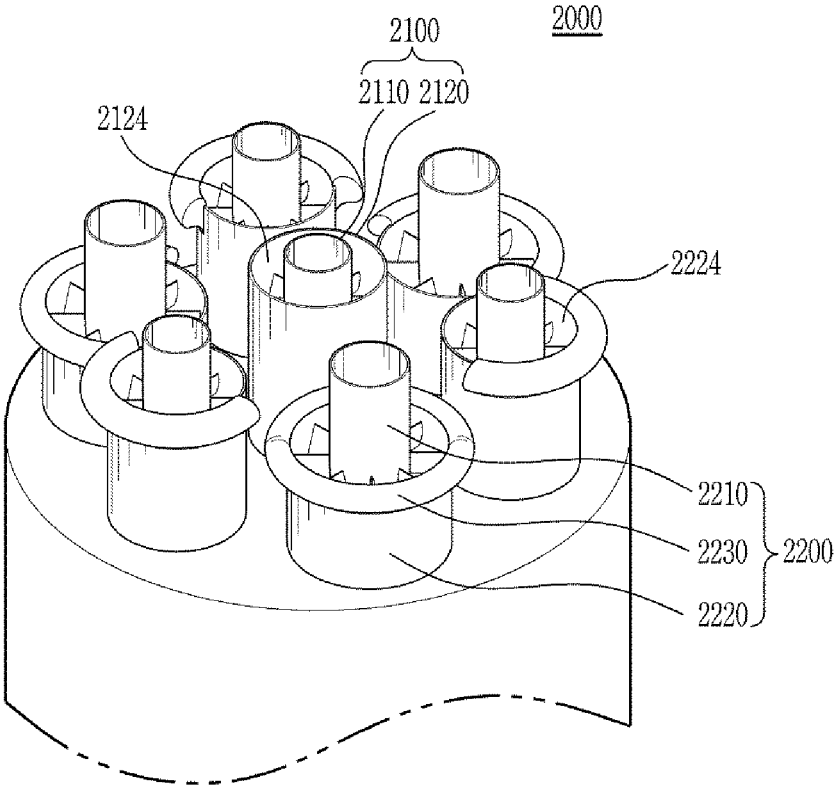

Referring to FIGS. 3A and 3B, a fuel nozzle assembly 2000 according to an embodiment of the present invention includes an inner fuel nozzle 2100 and at least one outer fuel nozzle 2200. Provided in this embodiment are a plurality of outer fuel nozzles 2200.

The inner fuel nozzle 2100 has a central body 2110, a shroud 2120 that surrounds and is spaced apart from the central body 2110, and an inlet 2124 formed at one end of the shroud 2120. Similarly, the outer fuel nozzle 2200 has a central body 2210, a shroud 2220 that surrounds and is spaced apart from the central body 2210, and an inlet 2224 formed at one end of the shroud 2220. The outer fuel nozzles 2200 are disposed radially about the inner fuel nozzle 2100. The same parts of the inner or outer fuel nozzle 2100 or 2200 as those of the fuel nozzle described above with reference to FIG. 2 will be not described hereinafter.

The shroud 2220 of the outer fuel nozzle 2200 may have a fuel nozzle rim 2230 formed at the inlet 2224. The fuel nozzle rim 2230 improves the uniformity of airflow into the outer fuel nozzle 2200.

In this embodiment, the fuel nozzle rim 2230 may be formed over at least a portion of the inlet 2224 of the shroud 2220 of at least one outer fuel nozzle 2200. For example, as shown in FIG. 3A, the fuel nozzle rim 2230 may be formed over a portion of the inlet of the shroud 2220 of the outer fuel nozzle 2200. As shown in FIG. 3B, the fuel nozzle rim 2230 may be formed over the entirety of the inlet 2224 of the shroud 2220 of the outer fuel nozzle 2200.

Figure 4:
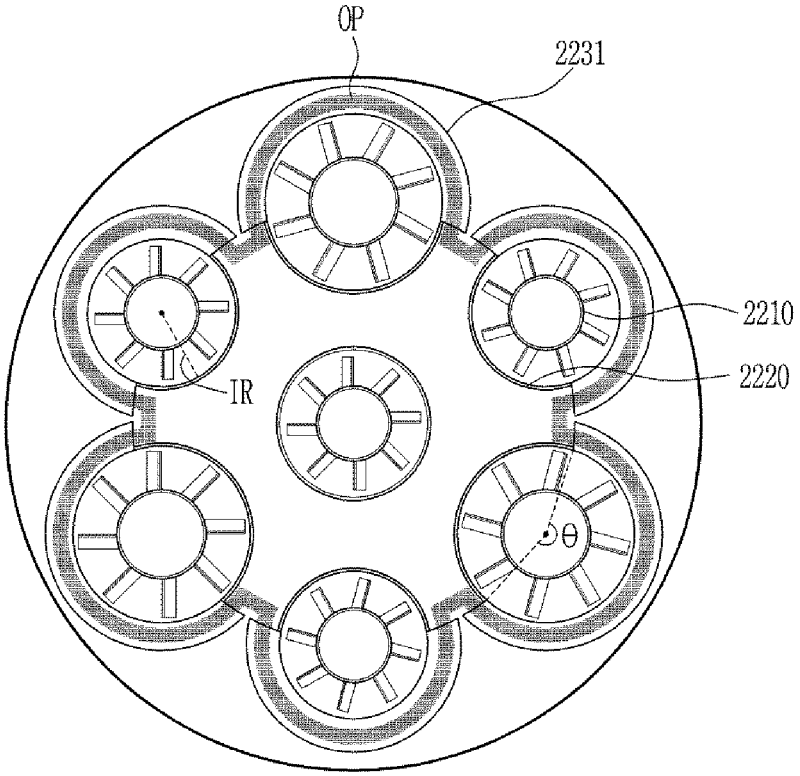
FIG. 4 is a schematic top view of a fuel nozzle assembly according to an embodiment of the present invention, conceptually showing an outer periphery of the fuel nozzle assembly.

In this manner, with reference to FIG. 4, collectively, the fuel nozzle rims 2230 of the fuel nozzle assembly 2000 may be disposed to cover at least a portion of an outer periphery OP formed by a series of outwardly facing edges of the shrouds 2220 of the outer fuel nozzle s 2200. Collectively, the fuel nozzle rims 2230 make up a peripheral rim 2231. In an embodiment, the peripheral rim 2231 of the fuel nozzle assembly 2000 may be disposed to cover the entirety of the outer periphery OP, as shown in FIG. 4.

Referring to FIG. 4, when the peripheral rim 2231 is formed to cover at least a portion of the outer periphery OP, an angle θ of the fuel nozzle rim 2230 may be referenced with respect to the center of any one outer fuel nozzle 2200, to represent the degree of formation of the fuel nozzle rim 2230 over a portion of the inlet 2224 of the shroud 2220. The angle θ may range from 90 degrees to 240 degrees and varies depending on the number of outer fuel nozzles 2200. Meanwhile, the shroud 2220 of one or more of the plurality of outer fuel nozzles 2200 may have an inlet radius IR that differs from that of other outer fuel nozzles 2200. On the other hand, the inlet radii of the shrouds 2220 may be equal to each other.

According to the present invention, the peripheral rim 2231 may be formed to cover some portion, or all, of the outwardly facing edges of the shrouds 2220 making up the outer periphery OP. That is, the peripheral rim 2231 may cover only outwardly facing edges of the shrouds 2220. Meanwhile, the fuel nozzle rim 2230 may be formed to cover some portion, or all, of the edges of the shroud 2220 of one or more of the plurality of outer fuel nozzles 2200. Therefore, alternatively, rather than the peripheral rim 2231 covering only outwardly facing edges of the shrouds 2220, a fuel nozzle rim 2230 may, as shown in FIG. 3B, completely cover the edges of the shroud 2220 of an outer fuel nozzle 2200. However, airflow uniformity is improved when the peripheral rim 2231 covers only outwardly facing edges of the shrouds 2220 and suffers when the fuel nozzle rim 2231 completely covers the edges of one or more shrouds 2220 of the outer fuel nozzles 2200. In addition, employing the peripheral rim 2231 to cover only outwardly facing edges of the shrouds 2220 provides greater spatial access during assembly and disassembly of the fuel nozzle assembly 2000 and thus facilitates the repair of the fuel nozzle assembly 2000 and the replacement of its components.

In other words, the peripheral rim 2231 includes a fuel nozzle rim 2230 formed at the inlet of the shroud 2220 of at least one of the plurality of outer fuel nozzles 2200 and may, as shown in FIG. 4, include the fuel nozzle rims 2230 formed at the shroud inlets of every outer fuel nozzle 2200. One or more of the fuel nozzle rims 2230 making up the peripheral rim 2231 may be formed to cover the corresponding inlet entirely (FIG. 3B), but the fuel nozzle rims 2230 are preferably formed with an angle ranging from 90 degrees to 240 degrees of the outer fuel nozzle 2200 (FIG. 3A).

Figure 5A:
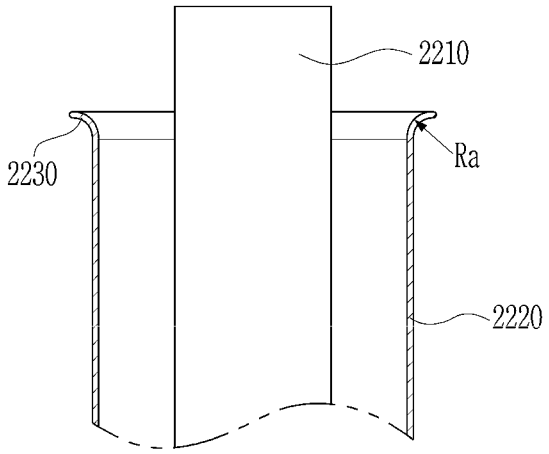
FIGS. 5A and 5B are partially cutaway side views of a fuel nozzle according to embodiments of the present invention, respectively showing alternative formations of a peripheral rim of the fuel nozzle.
Figure 5B:
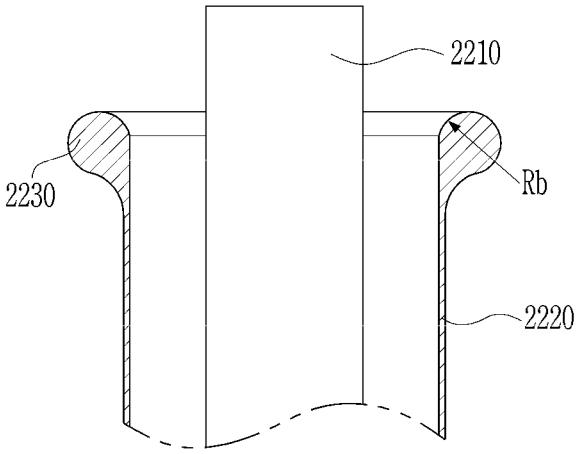

In the embodiment of FIG. 5A, the fuel nozzle rim 2230 may be extended from the shroud 2220 with the same thickness as that of the shroud 2220 and may follow an outwardly extending curve having a uniform curvature radius Ra. In the embodiment of FIG. 5B, the fuel nozzle rim 2230 may be extended from the shroud 2220 with an increased thickness (i.e., a blunt shape) in comparison to that of the shroud 2220 and may follow an outwardly extending curve having a uniform curvature radius Rb. These shapes of the fuel nozzle rim 2230 are exemplary only and not to be construed as a limitation. Meanwhile, the fuel nozzle rim 2230 of one or more of the plurality of outer fuel nozzles 2200 may have a curvature radius that differs from that of other outer fuel nozzles 2200.

Referring again to FIG. 4, the inlet radius IR of the shroud 2220 of an outer fuel nozzle 2200 may differ from that of another, because the size of the central body 2210 or the amount of air to be controlled by each outer fuel nozzle 2200 may vary. Therefore, in each outer fuel nozzle 2200, the curvature radius (e.g., Ra or Rb) of the fuel nozzle rim 2230 may vary depending on the inlet radius IR of the shroud 2220. This is because the curvature radius of the fuel nozzle rim 2230 needs to be changed in order to improve the uniformity of the airflow since the amount of inflow air varies according to the inlet radius IR of the shroud 2220. Preferably, the curvature radius of the fuel nozzle rim 2230 formed on a shroud 2220 having a smaller inlet radius IR is greater than the curvature radius of the fuel nozzle rim 2230 formed on a shroud 2220 having a larger inlet radius IR.

Figure 6:
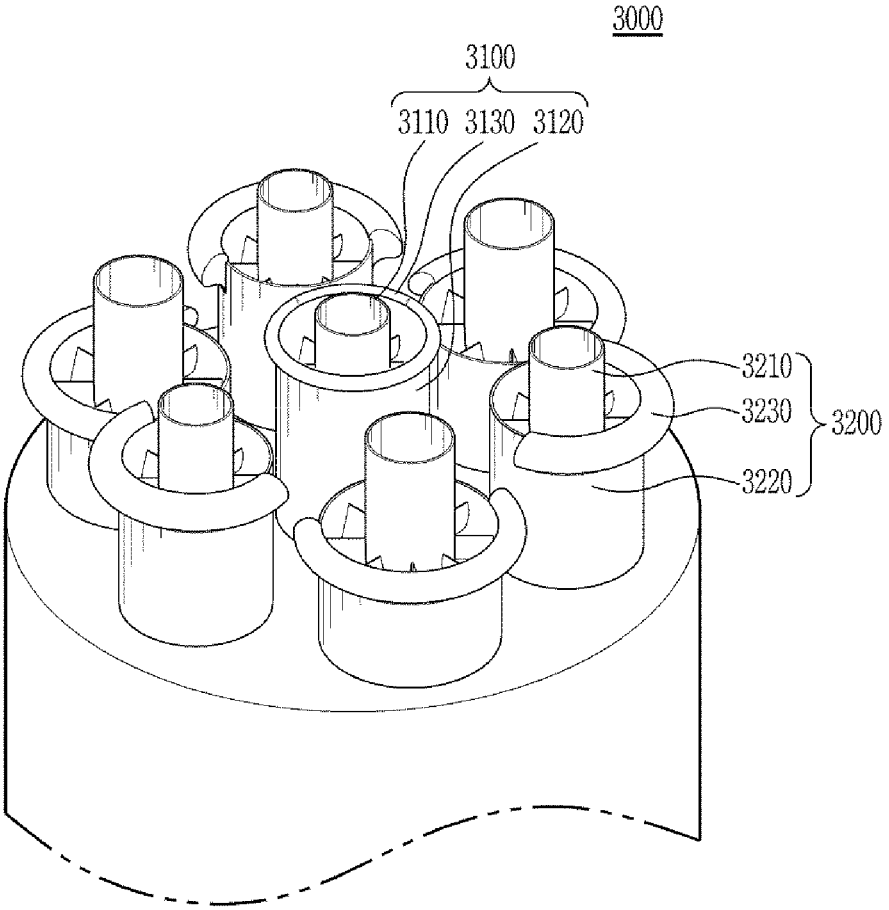
FIG. 6 is a perspective view of a fuel nozzle assembly including an inner fuel nozzle according to an embodiment of the present invention.

Referring to FIG. 6, a fuel nozzle assembly 3000 according to an embodiment of the present invention may include an inner fuel nozzle 3100 and an outer fuel nozzle 3200. The same parts of the inner or outer fuel nozzle 3100 or 3200 as those described above with reference to FIGS. 3 to 5 will be not described hereinafter.

As shown in FIG. 6, a shroud 3120 of the inner fuel nozzle 3100 may have a fuel nozzle rim 3130 formed at the shroud's inlet. Since the inner fuel nozzle 3100 is centrally situated, to be surrounded by the plurality of outer fuel nozzles 3200, the flow of air into the inner fuel nozzle 3100 is relatively uniform as compared with the outer fuel nozzle 3200. Thus, there is less need to form the fuel nozzle rim 3130 at the inlet of the shroud 3120 in the inner fuel nozzle 3100 than in the case of the outer fuel nozzles 2200. Nevertheless, the fuel nozzle rim 3130 may be formed on the shroud 3120 of the inner fuel nozzle 3100 to improve airflow uniformity.

Similar to the outer fuel nozzle rims shown in FIG. 5, the fuel nozzle rim 3130 formed on the shroud 3120 of the inner fuel nozzle 3100 may also be curved outwardly to have a uniform curvature radius and to have the same thickness as or a greater thickness than that of the shroud 3120. These shapes of the fuel nozzle rim 3130 are exemplary only and not to be construed as a limitation.

In the embodiment of FIG. 6, the curvature radius of the fuel nozzle rim 3130 formed in the inner fuel nozzle 3100 is smaller than the curvature radius of the fuel nozzle rim 3230 formed in the outer fuel nozzle 3200. Since the airflow is typically more uniform in the inner fuel nozzle 3100 than in the outer fuel nozzle 3200, airflow uniformity can be achieved even with relatively small curvature radii. Preferably, the curvature radius of the fuel nozzle rim 3230 of an outer fuel nozzle 3200 is at least 1.05 times greater than that of the fuel nozzle rim 130 of the inner fuel nozzle 3100. Reducing the radius of the fuel nozzle rim 2130 of the inner fuel nozzle 3100 improves space efficiency and facilitates assembly and disassembly of the fuel nozzle assembly 3000.

Figure 7:
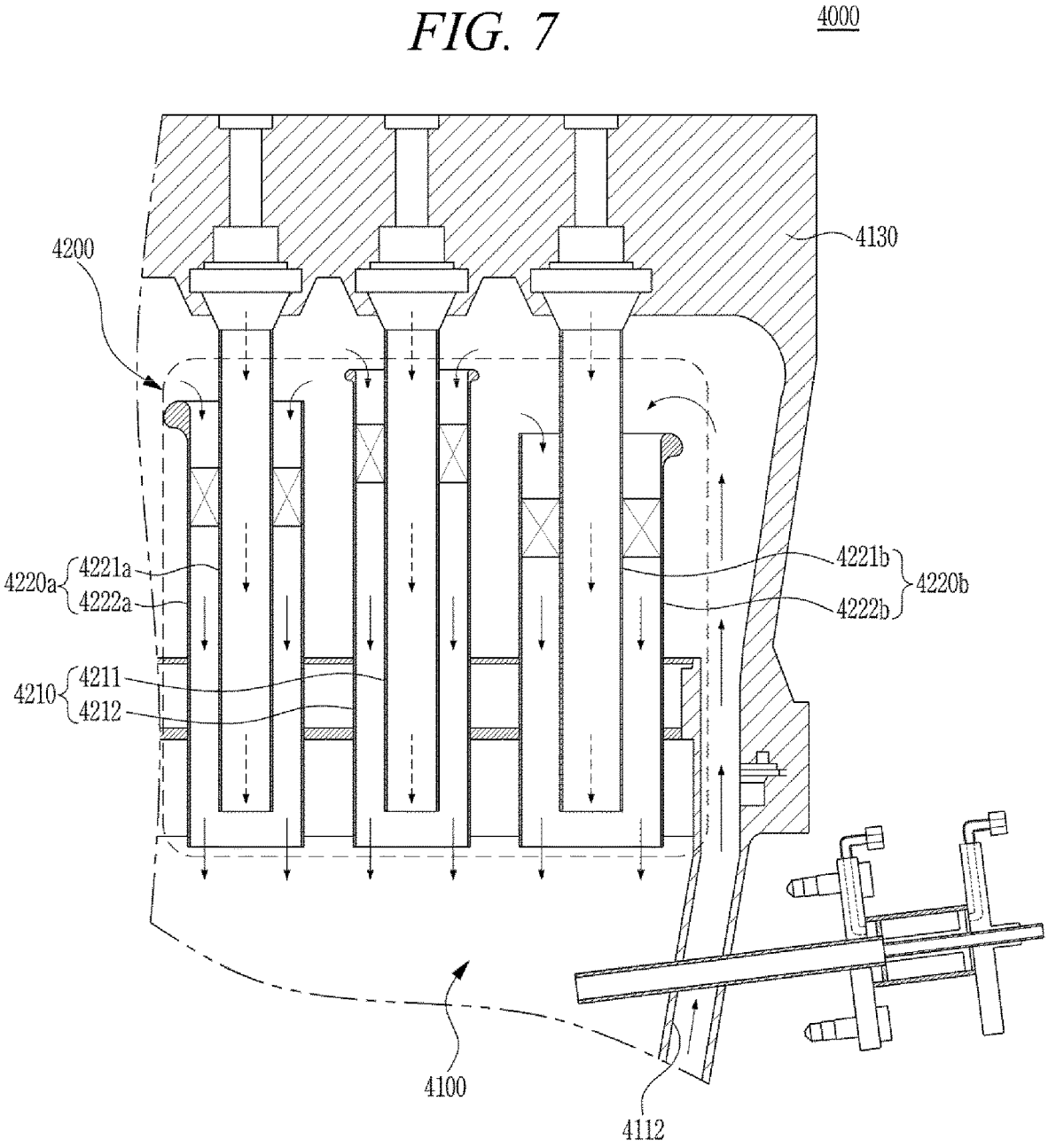
FIG. 7 is a schematic cross-sectional view of a portion of the combustor shown in FIG. 1.

Referring to FIG. 7, a combustor 4000 according to an embodiment of the present invention may include a fuel nozzle assembly 4200, a combustion liner 4112, and a combustion chamber 4100 surrounded by both the fuel nozzle assembly 4200 and the combustion liner 4112. The same parts of the combustor 4000 as those described above with reference to FIG. 2 will be not described hereinafter.

As shown in FIG. 7, the fuel nozzle assembly 4200 includes an inner fuel nozzle 4210 and a plurality of outer fuel nozzles 4220*a* and 4220*b*. An end plate 4130 supports a central body 4211 of the inner fuel nozzle 4210 and center bodies 4221*a* and 4221*b* of the outer fuel nozzles 4220*a* and 4220*b*.

In this embodiment, depending on positions of the inner fuel nozzle 4210 and the plurality of outer fuel nozzles 4220*a* and 4220*b*, distances between the end plate 4130 and the respective shrouds 4212, 4222*a*, and 4222*b* may be set differently. In one embodiment, the shroud 4212 of the inner fuel nozzle 4210 is located closer to the end plate 4130 than the shrouds 4222*a* and 4222*b* of the outer fuel nozzles 4220*a* and 4220*b*. When the inner fuel nozzle 4210 and the plurality of outer fuel nozzles 4220*a* and 4220*b* are differently spaced apart from the end plates 4130 depending on their positions, it is possible to improve the uniformity of the airflow and to prevent air pockets from being generated inside the fuel nozzles 4210, 4220*a*, and 4220*b*.

In another embodiment, the shrouds 4222*a* and 4222*b* of the outer fuel nozzles 4220*a* and 4220*b* may have different inlet radii. In this case, the smaller the inlet radius of the shrouds 4222*a* and 4222*b*, the shorter the distance between the end plate 4130 and the inlet of the shrouds 4222*a* and 4222*b*.

Figure 8:
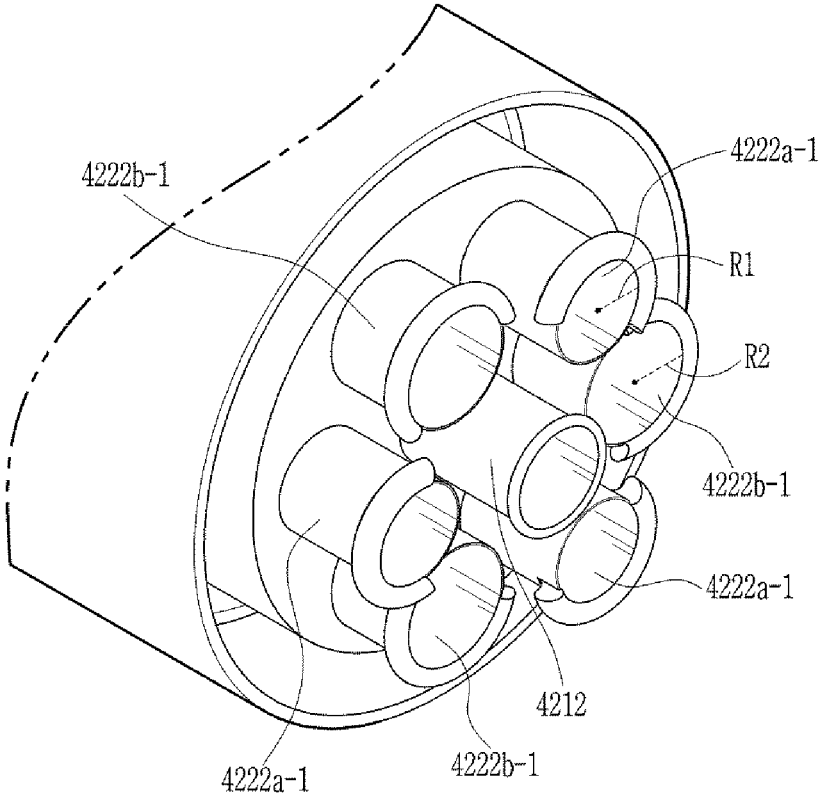
FIG. 8 is a perspective view of a combustor according to an embodiment of the present invention, showing alternatively formed shrouds of a fuel nozzle assembly.

In still another embodiment, as shown in FIG. 8, the outer fuel nozzles may be classified into a first outer fuel nozzle group 4222*a*-1 having a first inlet radius R1 of the shroud and a second outer fuel nozzle group 4222*b*-1 having a second inlet radius R2 of the shroud. Here, the first and second outer fuel nozzle groups 4222*a*-1 4222*b*-1 respectively include the fuel nozzles 4220*a* and 4220*b* alternately arranged around the inner fuel nozzle 4210. In this case, the first inlet radius R2 is greater than the second inlet radius R1. Further, the second outer fuel nozzle group 4222*a*-1 is closer to the end plate 4130 than the first outer fuel nozzle group 4222*b*-1. Although two types of inlet radii (R1 and R2) are used in this embodiment, three or more inlet radii may be used.

Figure 9:
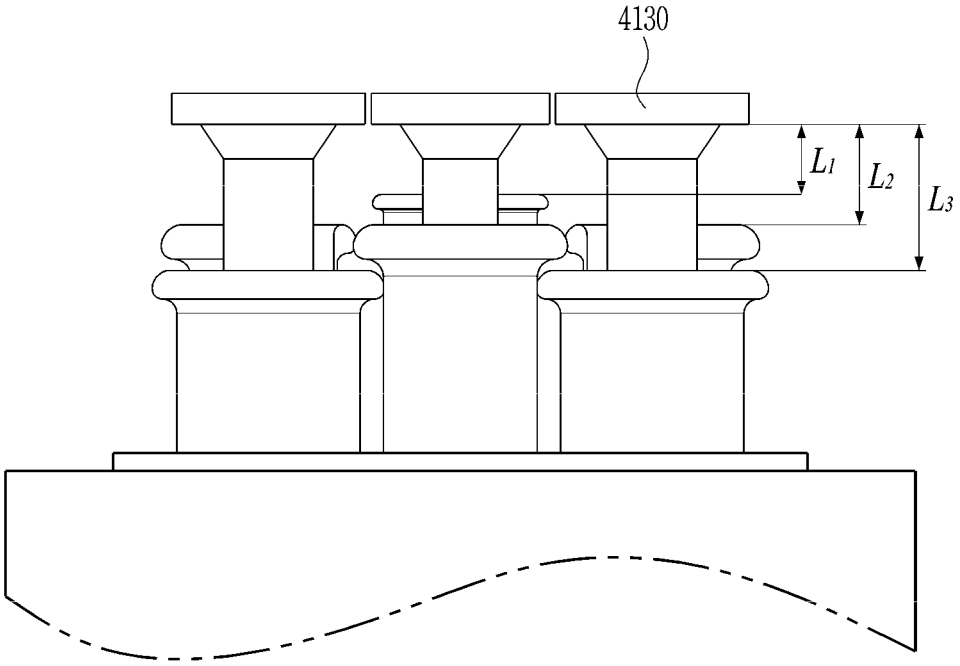
FIG. 9 is a schematic side view of a combustor according to an embodiment of the present invention, showing distances between various shrouds and an end plate of the combustor.

Referring to FIG. 9, there may be three specific distances between the end plate 4130 and the fuel nozzles 4210, 4220*a*, and 4220*b*. Assuming a distance L1 between the end plate 4130 and the inlet of the shroud 4212 of the inner fuel nozzle 4210, a distance L2 between the end plate 4130 and the inlet of the shroud 4222*a* of the first outer fuel nozzle group 4220*a*, and a distance L3 between the end plate 4130 and the inlet of the shroud 4222*b* of the second outer fuel nozzle group 4220*b*, the relation of the distances may be $L1<L2<L3$. In another embodiment, the relation of distances may be expressed as $L1\leq(0.8\times L3)$. In yet another embodiment, the relation of the distances may be expressed as $L2\leq(0.9\times L3)$.

As described hereinbefore in various embodiments, by adjusting the position and/or the curvature radius of the rim formed at the inlet of the shroud, and/or by differently setting the distance between the shroud and the end plate depending on the positions of the inner fuel nozzle and the outer fuel nozzles and/or the inlet radii of the shrouds, it is possible to realize a uniform airflow into the fuel nozzle assembly, including a uniform supply of air into respective fuel nozzles, and to facilitate assembly and disassembly of the fuel nozzle assembly. With the elimination of air pocket formation that comes with uniform airflow, it is further possible to prevent a locally high combustion temperature in the combustion chamber, reduce the creation of nitrogen oxides, prevent the occurrence of flame holding or anchoring in the fuel nozzle, and prevent damage of components of the combustor.

Although the above-described embodiments are regarding the gas turbine, the same may be also applied to other apparatuses for combusting fuel.

While the present disclosure has been particularly shown and described with reference to exemplary embodiments thereof, it is clearly understood that the same is by way of illustration and example only and is not to be taken in conjunction with the present disclosure. It will be understood by those skilled in the art that various changes in form and details may be made therein without departing from the subject matter and scope of the present disclosure.

What is claimed is:

1. A fuel nozzle assembly comprising:

an inner fuel nozzle;

a plurality of outer fuel nozzles disposed radially around the inner fuel nozzle, each outer fuel nozzle including a central body for fuel injection, a shroud spaced apart from and surrounding the central body, the plurality of shrouds forming an outer periphery of the fuel nozzle assembly, and an inlet formed at one end of the shroud; and a peripheral rim formed at the inlets and disposed to cover at least a portion of the outer periphery, wherein the plurality of outer fuel nozzles includes a first outer fuel nozzle group and a second outer fuel nozzle group, the outer fuel nozzles of the first and second outer fuel nozzle groups alternately arranged around the inner fuel nozzle such that each of the outer fuel nozzles of the first outer fuel nozzle group is disposed between two outer fuel nozzles of the second outer fuel nozzle group, and wherein each shroud of the plurality of outer fuel nozzles of the first outer fuel nozzle group has a first inlet radius, and each shroud of the outer fuel nozzles of the second outer fuel nozzle group has a second inlet radius greater than the first inlet radius.

2. The fuel nozzle assembly of claim 1, wherein the peripheral rim includes a fuel nozzle rim formed to cover at least a portion of the inlet of the shroud of at least one of the plurality of outer fuel nozzles.

3. The fuel nozzle assembly of claim 2, wherein the fuel nozzle rim of the at least one of the plurality of outer fuel nozzles has an angle ranging from 90 degrees to 240 degrees around a center of the at least one of the plurality of the outer fuel nozzles.

4. The fuel nozzle assembly of claim 2, wherein the fuel nozzle rim of the at least one of the plurality of outer fuel nozzles is curved outwardly to have a uniform curvature radius.

5. The fuel nozzle assembly of claim 2, wherein the peripheral rim has at least two different curvature radii.

6. The fuel nozzle assembly of claim 5, wherein the fuel nozzle rim of the at least one of the plurality of outer fuel nozzles has a curvature radius that depends on the inlet radius of a corresponding shroud.

7. The fuel nozzle assembly of claim 5, wherein the peripheral rim includes the fuel nozzle rim formed to cover at least a portion of the inlet of the shroud of each of the plurality of outer fuel nozzles, wherein one of the plurality of outer fuel nozzles includes a first shroud having a small inlet radius and another of the plurality of outer fuel nozzles includes a second shroud having a large inlet radius, wherein the at least two different curvature radii includes a first curvature radius of the fuel nozzle rim formed on the first shroud and a second curvature radius of the fuel nozzle rim formed on the second shroud, and wherein the first curvature radius is greater than the second curvature radius.

8. The fuel nozzle assembly of claim 1, wherein the inner fuel nozzle includes:

a central body for fuel injection;

a shroud spaced apart from and surrounding the central body of the inner fuel nozzle; and a fuel nozzle rim formed at an inlet of the shroud of the inner fuel nozzle.

9. The fuel nozzle assembly of claim 8, wherein the peripheral rim follows an outwardly extending curve having a first curvature radius, and the fuel nozzle rim formed on the shroud of the inner fuel nozzle follows an outwardly extending curve having a second curvature radius, the second curvature radius being smaller than the first curvature radius.

10. The fuel nozzle assembly of claim 9, wherein the first curvature radius is at least 1.05 times greater than the second curvature radius.

11. A combustor comprising:

a combustion chamber; and a fuel nozzle assembly mounted in the combustion chamber and connected to an end plate of the combustion chamber, the fuel nozzle assembly including:

an inner fuel nozzle;

a plurality of outer fuel nozzles disposed radially around the inner fuel nozzle, each outer fuel nozzle including a central body for fuel injection, a shroud spaced apart from and surrounding the central body, the plurality of shrouds forming an outer periphery of the fuel nozzle assembly, and an inlet formed at one end of the shroud, the one end of the shroud disposed at a set distance from the end plate, the set distance depending on at least one of relative positions of the inner fuel nozzle and the plurality of outer fuel nozzles, and an inlet radius of the corresponding shroud; and a peripheral rim formed at the inlets and disposed to cover at least a portion of the outer periphery, wherein the plurality of outer fuel nozzles consists of a first outer fuel nozzle group and second outer fuel nozzle group, each shroud of the outer fuel nozzles of the first outer fuel nozzle group having a first inlet radius and each shroud of the outer fuel nozzles of the second outer fuel nozzle group having a second inlet radius less than the first inlet radius, and wherein, assuming a distance L1 between the end plate and the inlet of the shroud of the inner fuel nozzle, a distance L2 between the end plate and the inlet of the respective shrouds of the second outer fuel nozzle group, and a distance L3 between the end plate and the inlet of the respective shrouds of the first outer fuel nozzle group, a relation of the distances is expressed as $L1<L2<L3$.

12. The combustor of claim 11, wherein the inner fuel nozzle includes a shroud located closer to the end plate than the shrouds of the outer fuel nozzles.

13. The combustor of claim 11, wherein the relation of the distances is expressed as $L1 \leq (0.8 \times L3)$.

14. The combustor of claim 11, wherein the relation of the distances is expressed as $L2 \leq (0.9 \times L3)$.

15. A gas turbine comprising:

a compressor for compressing air;

a combustor for mixing and burning the compressed air and fuel, the combustor including a combustion chamber and a fuel nozzle assembly mounted in the combustion chamber, the combustion chamber including a combustion liner, a casing disposed to be spaced apart from the combustion liner and to surround the combustion liner, and an end plate combined with the casing and connected to the fuel nozzle assembly; and a turbine for generating power through rotation by a combustion gas received from the combustor, wherein the fuel nozzle assembly includes:

an inner fuel nozzle;

a plurality of outer fuel nozzles disposed radially around the inner fuel nozzle, each outer fuel nozzle including a central body for fuel injection, a shroud spaced apart from and surrounding the central body, the plurality of shrouds forming an outer periphery of the fuel nozzle assembly, and an inlet formed at one end of the shroud; and a peripheral rim formed at the inlets and disposed to cover at least a portion of the outer periphery, wherein the plurality of outer fuel nozzles includes a first outer fuel nozzle group and a second outer fuel nozzle group, the outer fuel nozzles of the first and second outer fuel nozzle groups alternately arranged around the inner fuel nozzle such that each of the outer fuel nozzles of the first outer fuel nozzle group is disposed between two outer fuel nozzles of the second outer fuel nozzle group, and wherein each shroud of the outer fuel nozzles of the first outer fuel nozzle group has a first inlet radius, and each shroud of the outer fuel nozzles of the second outer fuel nozzle group has a second inlet radius greater than the first inlet radius.

* * * * *